252-147 AU 166 EX
3/29/83 XR 4,378,270

United States Patent [19]

Brasch

[11] 4,378,270

[45] Mar. 29, 1983

[54] METHOD OF ETCHING CIRCUIT BOARDS AND RECOVERING COPPER FROM THE SPENT ETCH SOLUTIONS

[75] Inventor: William R. Brasch, Nesconset, N.Y.

[73] Assignee: LeaRonal, Inc., Freeport, N.Y.

[21] Appl. No.: 316,108

[22] Filed: Oct. 29, 1981

[51] Int. Cl.[3] ..... C23F 1/00; C23F 1/02

[52] U.S. Cl. ..... 156/659.1; 75/117; 156/642; 156/656; 156/666; 204/106; 252/79.4; 252/147

[58] Field of Search ..... 156/642, 656, 659.1, 156/666, 901, 902; 423/23, 24; 252/79.2, 79.4, 146, 147; 134/3, 41, 10, 13; 204/106, 129.1, 129.65, 234, 186; 75/109, 117

[56] References Cited

U.S. PATENT DOCUMENTS 4,144,119 3/1979 Dutkewych et al. ..... 156/666 X

*Primary Examiner*—William A. Powell
*Attorney, Agent, or Firm*—Pennie & Edmonds

[57] ABSTRACT

The present invention relates to a method of etching copper with a hydrogen peroxide-sulfuric acid etchant containing an acid soluble phosphonic acid in the manufacture of electronic circuits utilizing a masked copper surface and to a method of recovering the copper from the spent etch solution by electrolysis in solid continuous form saleable as electrolytic copper.

11 Claims, No Drawings

METHOD OF ETCHING CIRCUIT BOARDS AND RECOVERING COPPER FROM THE SPENT ETCH SOLUTIONS

FIELD OF THE INVENTION

The present invention relates to a method of etching copper in the manufacture of electronic circuits utilizing a masked copper surface and to a method of recovering the copper in an economical manner from the spent copper etch solutions.

BACKGROUND OF THE INVENTION

There are many different etch solutions disclosed in the prior art for etching copper particularly for producing electronic circuits from copper laminates using etch resistant materials such as tin-lead (solder) resists. Etching solutions in use today include ammoniacal copper etchants, chloride copper etchants chromic acid etchants, ferric chloride etchants and hydrogen peroxide-sulfuric acid etchants.

Regardless of the particular etching solution employed, users always have the problem of what to do with the spent etching solution once it has become saturated with copper. Spent etchants contain large amounts of copper metal and the supplier of the etchants generally takes back the spent etchant and gives the user some credit for this spent solution. Hydrogen peroxide-sulfuric acid etchants, however, can carry only about half or even less than half of the copper carried by the ammoniacal or copper chloride etchants before they are spent or no longer usable. The users of hydrogen peroxide-sulfuric acid etchants generally do not return the copper-laden spent etchants to the supplier, but instead pump the spent solution out of the etching chamber and cool the solution sufficiently to permit crystallization of copper sulfate crystals. After the crystallization at reduced temperature, the solution, which is now fairly low in copper content, is then pumped back into the etching chamber for formula readjustment and reuse. One of the advantages of the hydrogen peroxide-sulfuric acid etchant is the ability to reuse the etching solution in the users facility with minimal expense in equipment, whereas with other etchants the solution is sent back to the supplier or discarded. The main disadvantage in reusing the hydrogen peroxide-sulfuric acid solutions is that the user is faced with a voluminous amount of copper sulfate crystals which must be handled, sold, or disposed of. These crystals are sharp and produce significant wear on the pumps that are being used to handle the crystals, and this, together with the necessity of handling large amounts of the crystals and finding a buyer or acceptable disposal site, makes this recovery process a difficult one for the user.

It has also been proposed to remove copper metal from the hydrogen peroxide-sulfuric acid etchants by plating out the copper electrolytically. The problem with this procedure has been that the copper metal does not deposit as an adherent homogeneous deposit but comes out as a powder or in a non-adherent loose formation which powders off into the solution and this makes recovery and handling of the copper very difficult. The use of certain grain refiners has also been proposed; however, these are not stable in the presence of a strong oxidizing agent under the conditions of electrolysis.

There are other methods that separate copper sulfate by membrane technology or by dissolving the copper sulfate crystals and then electrolyzing the solution but this involves additional steps and apparatus and is much more complicated than the method of the present invention.

U.S. Pat. No. 3,903,244 to Winkley discloses the stabilization of hydrogen peroxide solutions with amino methyl phosphonic acid or its soluble salts, and when these solutions are used in metal pickling the phosphonic acids precipitate iron contained in the solutions from the pickling operation and thus stabilizes the hydrogen peroxide against decomposition induced by the presence of ferric iron ions. Phenol is disclosed as useful in the compositions to control decomposition of hydrogen peroxide induced by non-ferric heavy metals, such as copper.

U.S. Pat. No. 3,905,907 to Shiga discloses hydrogen peroxide solutions incorporating an acid together with an alkyl hydrogen phosphate or an alkyl hydrogen phosphite. Phosphoric acid is mentioned as a possible etching acid along with sulfuric and other acids.

U.S. Pat. No. 3,373,113 to Achenbach discloses hydrogen peroxide sulfuric acid etching solutions containing phosphoric acid as a stabilizer for the hydrogen peroxide. The solutions are used to etch printed circuits in which the circuit is defined by an etch-resistant printing ink.

SUMMARY OF THE INVENTION

This invention comprises the use of hydrogen peroxide-sulfuric acid etch solutions for etching copper which contain an acid soluble organo phosphonic acid or salt of the acid in sufficient quantity to permit the recovery of the etched copper from the used etching solution by electrodeposition of the copper as pure adherent continuous copper metal in solid form salable as electrolytic copper.

The invention further includes a novel etch solution comprising hydrogen peroxide, sulfuric acid, phosphoric acid, an acid soluble organo phosphonic acid or salt and a hydrogen peroxide stabilizer which is particularly useful in etching copper circuit boards using a tin or tin-lead alloy (solder) resist.

The water soluble organo phosphonic acids and their salts useful according to this invention are sequestering or chelating agents and are well known and used as such.

Examples of organo phosphonic acids which can be used according to this invention include the acid soluble phosphonic acid and salts conforming to the structural formula:

$$R'_{(3-n)}-N-[R-\overset{\overset{\displaystyle O}{\|}}{P}-(OH)_2]_n$$

wherein R is a lower alkylidene radical and their water soluble salts, R' is hydrogen or a lower alkyl radical, and n is an integer from 1 to 3.

Some more specific examples of phosphonic acids coming within the above formula include those having the following structural formula:

$$N[R-\overset{\overset{\displaystyle O}{\|}}{P}-(OH)_2]_3 \quad NH[R-\overset{\overset{\displaystyle O}{\|}}{P}-(OH)_2]_2 \text{ and } NH_2R-\overset{\overset{\displaystyle O}{\|}}{P}-(OH)_2$$

wherein R contains 1 to 5 carbons atoms. Amino-trimethylphosphonic acid and its water soluble salts is particularly suitable for the present invention and hence it is the preferred additive. This compound has the structural formula:

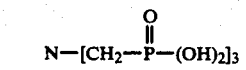

Hydroxy ethylidene diphosphonic acid and its soluble salts has also been found to be particularly suitable for use in the present invention.

Other phosphonic acids that can be used include amino-triethylidene phosphonic acid and amino-triisopropylidene phosphonic acid, 1-hydroxyethylidene-1,1-diphosphonic acid, and amino dimethylphosphonic acid mono carboxylic acid.

The organo-phosphonic compounds can be used alone or in admixture with other organo-phosphonic compounds.

The soluble salts preferred are the sodium and other alkali metal salts, such as potassium and lithium. Ammonium salts and water soluble amine salts which exhibit the characteristics of the alkali metal salts may also be used.

The amount of organo phosphonic acids or their salts is not critical. Anywhere from between about 0.1% and 20% by weight is useful and the optimum amount will depend on the particular phosphonic compound being employed and solubility in the system. Although higher amounts could be used if solubility permits, generally it is not economically desirable to do so.

The organo phosphonic acids and their salts can be added to the etching solution prior to the etching of the copper circuit board or after the circuit board has been etched and the etching solution spent or concentrated with copper from the etching process. Some of the organo phosphonic acid or salts may be consumed or used up during the etching process, and when adding the organo phosphonic acid compounds to the etching solution for use, a sufficient amount should be added to insure its presence in sufficient amounts during the electrodeposition of the copper to produce pure solid metallic copper on the cathode which can be stripped off and commercially sold as electrolytic copper. If an insufficient amount of the phosphonic acid is added to the etch solution, this can be made up by addition to the spent solution prior to electrodeposition. Generally the use of 5% by weight of the organo phosphonic acid or its salt will be sufficient when it is added to the etching solution prior to use. This amount is particularly advantageous when using the preferred phosphonic acids or salts. Without the organo phosphonic acids, the electrodeposited copper is non-homogeneous, powdery, and non-adherent to cathode.

It is advantageous to utilize the organo phosphonic acid or its salt in solution prior to using the solutions for etching copper in preparation of circuit boards. The presence of these acids or their salts serve to slow down the etching rate to give a more controlled etch. The decreased etch rate factor results in much less overhang of the resist since the copper that is under the resist does not dissolve as much as it would otherwise with a higher etching rate. The presence of the phosphonic acid or salt also retards the attack on the tin and tin-lead resist.

The addition of the phosphonic acids or salts to the etching solution is necessary to produce smooth adherent copper deposits on the cathode surface from the spent etchant solution which is not possible from conventional hydrogen peroxide-sulfuric acid etching solutions.

The invention further includes the use of phosphoric acid in the etch solution in combination with the organo phosphonic acid or salt. The phosphoric acid has also been found to unexpectedly retard the attack of the etching solution on tin-lead (solder) etch resist. This retardation is very important to preserve the solderability of the tin-lead. The amount of phosphoric acid in combination with the phosphonic acids should be sufficient to effect a significant retardation of the attack of the etching solution upon a tin or tin-lead resist. Generally between about 1 ml and 100 ml of concentrated phosphoric acid per liter can be employed. 50 ml/l of concentrated phosphoric acid has been found to be most advantageous.

The hydrogen peroxide preferred is a 35–50% by volume hydrogen peroxide aqueous solution, although both higher and lower hydrogen peroxide concentrations can be employed.

The portions of hydrogen peroxide to concentrated sulfuric acid can be those normally used in conventional hydrogen peroxide-sulfuric acid etching solutions. When using 100 ml/l of 35% hydrogen peroxide by volume, it is preferred to use concentrated sulfuric acid at approximately 100 ml/l, although more or less could be used if desired.

Phenolsulfonic acid is added to retard hydrogen peroxide breakdown or disassociation especially in the presence of dissolved copper. Generally only a very small amount of the phenolsulfonic acid is necessary to accomplish this purpose, and when using 100 ml/l of 35% hydrogen peroxide by volume, it is preferred to use about 1.5 ml/l of the phenolsulfonic acid.

EXAMPLE

The following etch solution was employed to etch copper-clad circuit boards in which a tin-lead etch resist was used to define the circuitry.

| | |
|---|---|
| Hydrogen Peroxide (35% by vol.) | 100 ml/l |
| Concentrated Sulfuric Acid | 100 ml/l |
| Amino-Trimethylphosphoric Acid (50% solution) | 100 ml/l |
| Phosphoric Acid ($H_3PO_4$) | 50 ml/l |
| Phenolsulfonic acid | 1½ ml/l |

The solution was used until it was spent and at this stage the solution contained about 60 g/l of dissolved copper metal. The solution was pumped into the electrolytic plating chamber which contained a number of alternate anodes and cathodes to provide a large anode and cathode area. The solution volume was about 300 gallons and the total amperage used was 4000 amps. The current density used at the cathode was 40 ASF; 100 square feet of cathode surface was provided. The cathode start sheets were stainless steel and the anodes were chemical lead. The cathode starter sheets were first passivated in nitric acid so that the smooth copper deposit would not adhere too strongly thereto and could be easily separated or peeled from the cathode in order to collect the pure copper deposit after electrolysis. During the first two hours of electrolysis the solution quickly heated up to about 140°–150° F. because of the amount of current flowing through such a small volume of solution. During this initial two-hour period, the hydrogen peroxide was destroyed by both heat and electrolysis. After this initial two-hour period, and the destruction of the peroxide, copper began to plate out on the cathode and continued to plate out on the cathode for a period of about 12 to 14 hours. At the end of this time the solution analyzed 7.5 g/l of copper metal and the electrolysis was discontinued. The solution was then pumped back into the etching chamber, analyzed and adjusted by replenishing the solution to the initial formulation, and then reused as a copper etchant. The compact copper film on the nitric-acid passivated stainless steel cathodes was peeled away, analyzed to be pure copper, and sold as pure electrolytic copper. It was noted that the attack of the etch solution on the tin-lead resist was very minor and the overhang was at a minimum.

It is noted that the hydrogen peroxide is destroyed in this copper recovery process and must be replaced, but the cost factors clearly benefit the present process even though the hydrogen peroxide must be replaced. The value of pure electrolytic copper is a great deal higher than the value of copper sulfate crystals recovered from the hydrogen peroxide-sulfuric acid etchants by prior art methods. The handling of the copper metal is much easier and more economical than the handling of copper sulfate crystals let alone the handling of a large volume of copper sulfate crystals, which is about five times greater than that of the equivalent amount of copper metal.

The copper can be recovered from the etch solutions at lower concentrations than saturation or 60 g/l if desired. Reducing the copper content to 7–10 g/l generally produces an etch solution which can be economically reused.

I claim:

1. The method of recovering copper from spent hydrogen peroxide-sulfuric acid etching solutions which comprises adding an acid soluble organo phosphonic acid or salt to the etching solution prior to or after use of the solution as an etchant and electrodepositing the copper from the solution in the form of solid continuous pure copper metal.

2. The method according to claim 1 in which the organo phosphoric acid or salt is added prior to use of the solution as an etchant.

3. The method of claim 1 or 2 in which the phosphonic acid or salt is amino trimethyl phosphonic acid or a salt thereof or hydroxy ethylidene diphosphonic acid or a salt thereof.

4. The method of etching copper which comprises treating the copper with an etch solution containing hydrogen peroxide, sulfuric acid and an acid soluble organo phosphonic acid or salt thereof and recovering the copper contained in the etch solution as a result of the copper etching by electrolytic deposition as solid continuous pure copper metal.

5. A copper etching solution for copper circuit boards having the circuitry defined by a tin or tin-lead resist which comprises hydrogen peroxide, sulfuric acid, an acid soluble organo phosphonic acid or salt, phosphoric acid in an amount sufficient to retard etching of the solder resist, and a phenol stabilizer for the hydrogen peroxide.

6. The etching solution of claim 5 in which the stabilizer for the hydrogen peroxide is phenolsulfonic acid.

7. The method of etching copper circuit boards to form a circuit which comprises etching the copper with a solution comprising hydrogen peroxide, sulfuric acid, an acid soluble phosphonic acid or salt, phosphoric acid and a phenol stabilizing agent for the hydrogen peroxide in the presence of copper.

8. The method of claim 7 in which the stabilizer is phenolsulfonic acid.

9. The method of claims 4, 5, 7 or 8 in which the phosphonic acid or salt is amino trimethyl phosphonic acid or a salt thereof or hydroxy ethylidene diphosphonic acid or a salt thereof.

10. The method of etching copper circuit boards containing a resist pattern which comprises etching the copper with a hydrogen peroxide-sulfuric acid etching solution containing an acid soluble organo phosphonic acid or salt thereof in a sufficient amount to retard the etching rate of the hydrogen peroxide-sulfuric acid etching solution and to reduce the tendency of the etching solution to undercut the resist and produce overhang.

11. An etch solution comprising hydrogen peroxide, sulfuric acid, an acid soluble organo phosphonic acid or salt, phosphoric acid and phenolsulfonic acid.

* * * * *